US005358535A

United States Patent [19]

Didier et al.

[11] Patent Number: 5,358,535

[45] Date of Patent: Oct. 25, 1994

[54] USE OF POLYALKYLENEGLYCOL DIESTERS AS FORMALDEHYDE COLLECTORS AND FINISHING PROCESS FOR THE TEXTILE INDUSTRY

[75] Inventors: Wilhelm Didier, Issy Les Moulineaux; Antonio Gelabert, Bouffemont-Moisseles, both of France

[73] Assignee: Societe Francaise Hoechst, Puteaux, France

[21] Appl. No.: 57,914

[22] Filed: May 7, 1993

[30] Foreign Application Priority Data

May 7, 1992 [FR] France ..... 92 05653

[51] Int. Cl.[5] ..... D06M 15/423; D06M 101/06

[52] U.S. Cl. ..... 8/182; 8/184; 8/185; 8/186; 8/115.7; 252/18.8; 252/8.9; 428/365; 428/224; 428/288; 428/290; 427/396; 427/399; 427/439

[58] Field of Search ..... 8/182, 137, 137.5, 115.56, 8/116.1, 115.7, 185, 186, 184; 252/8.8, 8.9; 560/176, 178; 428/365, 224, 290, 288; 427/439, 396, 399

[56] References Cited

U.S. PATENT DOCUMENTS 5,160,503 11/1992 Smith ..... 8/182

FOREIGN PATENT DOCUMENTS

WO88/09323 12/1988 PCT Int'l Appl. .

OTHER PUBLICATIONS

Van Bergen et al., *JCS Chem. Comm.*, 1976, pp. 964–966.

Tomasino et al., Textile Chemists and Colorists, 1984, 16 (12), pp. 33–38.

WPI, File Supplier, Derwent Publications Ltd.; London, GB.; AN=74-27755V & JP-A-085 741; (Nippon Synthetic Chem Inc.); Nov. 13, 1973.

*Primary Examiner*—Prince Willis, Jr.
*Assistant Examiner*—Alan D. Diamond
*Attorney, Agent, or Firm*—Browdy and Neimark

[57] ABSTRACT

Use as formaldehyde collectors of the products of formula $$R\left(O-CHR_1-(CH_2)_n-O\right)_mR \qquad (I)$$

in which R represents an acetoacetyl or 3,5-dioxo hexanoyl group, $R_1$ represents a hydrogen atom or a methyl radical, m is equal to 1, 2, 3 or 4 and n is either equal to 1 when $R_1$ represents a methyl radical or equal to 1, 2 or 3 when $R_1$ represents a hydrogen atom, and finishing process for fabrics based on cellulose fibers using an aminoplastic resin containing formaldehyde in the free or combined state, using a product of formula (I) as the formaldehyde collector.

12 Claims, No Drawings

USE OF POLYALKYLENEGLYCOL DIESTERS AS FORMALDEHYDE COLLECTORS AND FINISHING PROCESS FOR THE TEXTILE INDUSTRY

The present invention relates to the use of polyalkyene-glycol diesters as formaldehyde collectors and a finishing process for the textile industry.

Formaldehyde is widely used in the preparation of various aminoplastic resins, in particular for obtaining resins intended for finishing textile fibers such as urea-glyoxalformaldehyde resins. In spite of the care used in their preparation, these resins very often contain small traces of formaldehyde and, under certain conditions, in particular during their application to fabrics, they release the formaldehyde. Now, formaldehyde is a very penetrating, unpleasant, pungent-smelling gas; therefore very early on various methods were sought to fix it and/or to limit its release. Thus, various carbonylated compounds were proposed as a formaldehyde collector, possessing a methyl or methylene group in the alpha position such as acetaldehyde, acetone, acetylacetone, ether esters of acetylacetic acid and also more generally active methylene compounds such as nitroalkanes, dialkanol malonates (French Patent No. 989465 and 2575754, European Patent Application No. 2596, British Patent No. 2058099, Polish Patent No. 72885, Japanese Patent Application No. 73-17755, PCT Patent Application No. WO88/09323 and C. TOMASINO et al, Textile Chemists and Colorists, 1984, 16, (12), 33–38).

However, these various products, although they are active, do not give total satisfaction according to a man skilled in that art.

Now, the Applicant has discovered with astonishment that certain polyalkyleneglycol diesters with di- or triacetic acid have excellent properties for collecting the formaldehyde present in fabrics based on cellulose fibers finished with aminoplastic resins containing formaldehyde in the free or combined state.

This is why a subject of the present invention is the use of products of formula (I):

$$R—O—CHR_1—(CH_2)_n—O_mR \quad (I)$$

in which R represents an acetoacetyl or 3,5-dioxo hexanoyl group, $R_1$ represents a hydrogen atom or a methyl radical, m is equal to 1, 2, 3 or 4, and n is either equal to 1 when $R_1$represents a methyl radical, or equal to 1, 2, 3 when $R_1$ represents a hydrogen atom, as formaldehyde collectors.

A more particular subject of the invention is the use as formaldehyde collectors of the products as defined above, characterized in that in formula (I), R and $R_1$ have the meaning given previously, n is equal to 1 and m is equal to 1 or 2.

Among the latter products, there can be used in particular as formaldehyde collectors, the products of general formula (I) above, characterized in that R represents the acetoacetyl group, $R_1$ represents a hydrogen atom or a methyl radical, n is equal to 1 and m is equal 1 or 2.

Among the latter products, there can be mentioned more particularly:

ethylene bis(acetoacetate), oxydiethylene bis(acetoacetate).

The diesters of ethyleneglycol, of diethyleneglycol, and of 1,4-butanediol with acetoacetic acid (diacetic acid) are known: Beil. III, 4th supplement, page 1543 and T. R. PATTERSON et al, J. Amer. Chem. Soc., 1959, 81, 4213–17. They can be prepared in particular according to the methods described by R. J. CLEMENS, Chem. Rev., 1986, 86, 250 and J. Org. Chem., 1985, 50, 2431–35. More generally, polyalkyleneglycol diesters of general formula (II):

$$HO\left(CHR_1—(CH_2)_n—O\right)_mH \quad (II)$$

in which $R_1$, m and n have the meaning given previously, with acetylacetic acids and 3,5-dioxo hexanoic acid, can be obtained by transesterification either of ethyl acetoacetate, or of ethyl 3,5-dioxo hexanoate with the corresponding polyalkyleneglycol of formula (II) according to the method quoted by T. R. PATTERSON et al (reference already mentioned).

As has been said previously, the products of formula (I) have very useful properties as formaldehyde collectors, and in particular they allow the amount of free formaldehyde present in and/or released by fabrics based on cellulose fibers, finished with aminoplastic resins containing formaldehyde in the free or combined state, to be very considerably lowered.

For their use in the domain of the finishing of fabrics based on cellulose fibers with aminoplastic resins currently used to give the fabrics crease-resistance properties such as standard urea-glyoxal-formaldehyde resins, etherified or not with an alkanol such as methanol, the products of the invention of formula (I) defined above are used in solution in a finishing bath, preferably at a dose of 0.001 to 2 moles per liter of finishing bath (also called processing bath) and then the finishing is carried out under the usual conditions. After treatment, the fabrics thus finished contain practically no free formaldehyde and/or formaldehyde which may be released.

This is why a subject of the present Application is also a finishing process for fabrics based on cellulose fibers using an aminoplastic resin containing formaldehyde in the free or combined state in which the fabrics are placed in a finishing bath, characterized in that a product of formula (I) as defined above, in particular ethylene bis(acetoacetate) or oxydiethylene bis(acetoacetate), is used in the said finishing bath as a formaldehyde collector.

The following examples are given for information only; they allow a better understanding of the invention but they do not limit its scope.

Except where indicated to the contrary, the parts and percentages are given by weight. The crease-resistance test is carried out according to the AATCC 66-1972 standard, the crease recovery is expressed by the sum of the angles of crease recovery obtained in the direction of the warp and in the direction of the weft. The resistance to traction of the samples, expressed in daN, in the direction of the warp plus the direction of the weft is carried out according to the AFNOR G 07.001 standard. The yellowing of the fabric, carried out on a FIXOTEST apparatus at 185° C. for 30 seconds, and the whiteness, expressed in degrees Berger, are measured with a spectrophotometer.

The amounts of formaldehyde, expressed in ppm, are determined according to the AATCC 112-1984 standard, designated hereafter AATCC 112.

The ethylene bis (acetoacetate) was prepared according to T. R. PATTERSON et al (reference already mentioned). It is presented in the form of a liquid having a boiling point under 0.7 mbar of 150°-152° C. The oxydiethylene bis (acetoacetate) was also prepared according to T. R. PATTERSON et al. It is presented in the form of a liquid having a boiling point under 1.2 mbar of 178°-180° C.

EXAMPLES 1-4

A 100% cotton poplin fabric, which has been scoured and bleached, weighing about 130 g per square meter with a 75% wring-out rate, is impregnated in a padding machine in an aqueous bath, the pH of which is indicated in table I, containing in solution:

55 g/l of a commercial resin sold by the Applicant under the name ARKOFIX ® NFL Conc. which is a urea-glyoxalformaldehyde resin weakly etherified with methanol, 15 g/l of a catalyst marketed by the Applicant under the name catalyst 3282, 2 g/l of a wetting agent: nonylphenol ethoxylated with 10 moles of ethylene oxide, 100 mmoles/l either of ethylene bis (acetoacetate) (Example 1), or of oxydiethylene bis (acetoacetate) (Example 2).

The fabric is then dried for 45 seconds at 120° C., then it is thermally treated for 35 seconds at 180° C. on a laboratory stenter.

The following are then determined on samples of the treated fabric:

crease recovery, resistance to traction, hereafter called Rt, whiteness, hereafter called Wh, yellowing, hereafter called Ye, the amount of free formaldehyde, expressed in ppm, hereafter called F.

The results obtained are given in Table I as a comparison with a non-treated fabric (Example 3) and a fabric treated in the conventional way in the absence of a formaldehyde collector (Example 4).

Examination of Table I permits the observation that the fabrics finished in the presence of a formaldehyde collector according to the present invention contain practically no formaldehyde.

COMPARATIVE EXAMPLES C1 AND C2

Example 1 is reproduced replacing the ethylene bis (acetoacetate) with 200 mmoles per liter of bath of ethyl 2-hydroxy acetoacetate prepared according to Example 1 of the Patent Application PCT WO88/09323 (Example C1).

Similarly, Example 1 is reproduced replacing the ethylene his (acetoacetate) with 200 mmoles per liter of bath of di(2-hydroxy ethoxyethyl) malonate prepared according to Example 2 of the Patent Application PCT WO88/09323 (Example C2).

The results obtained in these two comparative examples are given in Table I. It is observed that the products according to the present invention give much better results with regard to the amounts of formaldehyde measured on the fabrics thus treated.

TABLE I

| | EXAMPLES | | | | | |
|---|---|---|---|---|---|---|
| | 1 | 2 | 3 | 4 | C1 | C2 |
| ARKOFIX NFL Conc (g/l) | 55 | 55 | 0 | 55 | 55 | 55 |
| Catalyst 3282 (g/l) | 15 | 15 | 0 | 15 | 15 | 15 |

TABLE I-continued

| | EXAMPLES | | | | | |
|---|---|---|---|---|---|---|
| | 1 | 2 | 3 | 4 | C1 | C2 |
| pH | 3.8 | 3.7 | | 4.1 | 2.5 | 3.8 |
| Crease recovery | 274 | 272 | 204.5 | 262 | 279.5 | 277.5 |
| Rt | 67.3 | 67.8 | 105 | 71.4 | 50.3 | 61.2 |
| Wh | 69.4 | 69.1 | 71.3 | 72.3 | 61.5 | 72.1 |
| Ye | 66.1 | 66.7 | 70.5 | 70.2 | 56.8 | 68.2 |
| F (ppm) | 2 | 2 | 0 | 200 | 20 | 17 |

We claim:

1. In a finishing process for fabrics based on cellulose fibers using an aminoplastic resin containing formaldehyde in the free or combined state in which the fabrics are placed in a finishing bath, the improvement wherein a compound of formula I $$R\text{-}(O-CHR_1-(CH_2)_n-O)_m\text{-}R \qquad (I)$$

in which R represents an acetoacetyl or 3,5-dioxo hexanoyl group, $R_1$ represents a hydrogen atom or a methyl radial, m is equal to 1, 2, 3 or 4, and n is either equal to 1 when $R_1$ represents a methyl radical or equal to 1, 2 or 3 when $R_1$ is hydrogen, is present as a formaldehyde collector.

2. Process according to claim 1, characterized in that 0.001 to 2 moles of said compound of Formula I is used as the formaldehyde collector per liter of finishing bath.

3. Process according to claim 2, characterized in that ethylene bis (acetoacetate) is used as the formaldehyde collector.

4. Process according to claim 2, characterized in that oxydiethylene bis (acetoacetate) is used as the formaldehyde collector.

5. A process according to claim 1, wherein R is acetoacetyl or 3,5-dioxo hexanoyl group, $R_1$ represents a hydrogen atom or a methyl radical, m is equal to 1 or 2 and n is equal to 1.

6. A process according to claim 5, wherein R is acetoacetyl group, $R_1$ represents a hydrogen atom or a methyl radical, m is equal to 1 or 2 and n is equal to 1.

7. A finished textile product made by the process of claim 1.

8. A method of preventing or inhibiting the release of formaldehyde present in fabrics based on cellulose fibers finished with aminoplastic resin containing formaldehyde in free or combined state, comprising incorporating in said aminoplastic resin a compound of the formula (I)

$$R\text{-}(O-CHR_1-(CH_2)_n-O)_m\text{-}R \qquad (I)$$

in which R represents an acetoacetyl or 3,5-dioxo hexanoyl group, $R_1$ represents a hydrogen atom or a methyl radial, m is equal to 1, 2, 3 or 4, and n is either equal to 1 when $R_1$ represents a methyl radical or equal to 1, 2 or 3 when $R_1$ represents a hydrogen atom.

9. Method according to claim 8, wherein R is acetoacetyl or 3,5-dioxo hexanoyl group, $R_1$ represents a hydrogen atom or a methyl radical, m is equal to 1 or 2 and n is equal to 1.

10. Method according to claim 9, wherein R is acetoacetyl group, $R_1$ represents a hydrogen atom or a methyl radical, m is equal to 1 or 2 and n is equal to 1.

11. Method according to claim 8, wherein said compound is ethylene bis (acetoacetate).

12. Method according to claim 8, wherein said compound is oxydiethylene bis (acetoacetate).

* * * * *